US005397551A

United States Patent [19]

Won Sam

[11] Patent Number: 5,397,551

[45] Date of Patent: Mar. 14, 1995

[54] INCINERATOR

[75] Inventor: Kim Won Sam, Seoul, Rep. of Korea

[73] Assignee: Daesung Industrial Co., Ltd., Rep. of Korea

[21] Appl. No.: 911,003

[22] Filed: Jul. 9, 1992

[51] Int. Cl.[6] ..... B01J 19/08

[52] U.S. Cl. ..... 422/186; 422/191; 422/308; 422/900; 431/356; 588/210; 588/211; 588/214; 588/225; 588/227; 588/243; 588/900

[58] Field of Search ..... 422/186, 191, 900, 308; 588/210, 211, 214, 225, 227, 243, 900; 431/356

[56] References Cited

U.S. PATENT DOCUMENTS

| | | | |
|---|---|---|---|
| 4,718,358 | 1/1988 | Nomi et al. | 110/250 |
| 4,759,300 | 7/1988 | Hansen et al. | 110/229 |
| 5,046,435 | 9/1991 | Kugler | 110/346 |
| 5,046,436 | 9/1991 | Fowler | 110/349 |
| 5,052,313 | 10/1991 | Walker | 110/346 |
| 5,072,675 | 12/1991 | Fowler | 110/346 |
| 5,084,141 | 1/1992 | Holland | 201/19 |
| 5,112,585 | 5/1992 | Dirks et al. | 423/210 |
| 5,209,355 | 5/1993 | Mindermann | 209/3.1 |
| 5,272,299 | 12/1993 | Ovadia | 219/10.55 R |
| 5,280,757 | 1/1994 | Carter et al. | 110/346 |

*Primary Examiner*—Daniel D. Wasil
*Assistant Examiner*—Daniel Jenkins
*Attorney, Agent, or Firm*—Quarles & Brady

[57] ABSTRACT

The present invention relates to an incinerator devised to incinerate various kinds of wastes including medical and food wastes. Up to this time, the waste containing an explosive chemical substance like alcohol or the waste containing water in large quantities has been disposed of unsanitarily, requiring a great deal of labor and cost. The present invention is equipped with a primary combustion chamber, a secondary combustion chamber, a communicating means which introudces gases to the secondary combustion chamber from the primary combustion chamber, an exhaust means which discharges waste gas from the secondary combustion chamber and a microwave generation means. It is an incinerator aimed to solve the above problem by a method wherein waste is incinerated after it is desiccated and pyrolyzed by applying microwaves thereto and explosive gas is disposed of. It is an sanitary incinerator which contains no bad smell, no harmful substance and no smoke in the exhaust gas discharged after incineration.

20 Claims, 2 Drawing Sheets

INCINERATOR

BACKGROUND OF THE INVENTION

1. Field of the invention

The present invention relates to an incinerator devised to dispose of various wastes including medical and food wastes by throwing them into fire.

2. Description of the prior art

Although a demand for proper disposal of wastes has been made in each field of our society in recent years, the present condition is that incineration by oil or gas burner or a device and a method in which supporting incineration is conducted by it is the mainstream of incineration. It is confined to the adoption of an incinerator and an incinerating method for gasified combustion in some high molecular substance.

Since disposal of wastes is not the manufacture or production of a new article, it is conducted by using a device or a method wherein many problems remain unsolved in extreme pursuit of a curtailment in disposal cost with the exception of some public disposal facilities. As a result, there are many instances where air polution is caused as secondary pollution by the discharge of harmful material [$SO_2$, $NO_2$, HCl, PCDPs (polychlorinated dibenzo-p-dioxins), PCDFs (polychlorinated dibenzofurans)] generated by the diffusion of harmful material contained in wastes due to dissociation or by the conduct of disposal.

Although there is a tendency to dispose of wastes which have many and unspecified sources of discharge like urban dust or wastes produced in large-scale manufacturing plants in a separate way, it has not yet reached an idealistic stage. The actual condition is that most of the wastes are mixedly collected, carried and disposed of by public disposal facilities as general wastes resultant from business activities or incinerated by being mixed with other industrial wastes, and there occurs a leak in a series of disposal including collection and transport.

In particular, the so-called medical wastes produced in the medical places, for example, HIV, infectious wastes from hapatitis and other communicable diseases, removed internal organs, placentas, blood and humors, the leavings of patients' meals and the remains of uroscopy and scatoscopy are so likely to cause secondary infection that it is desirable to dispose of those wastes selectively and promptly before they are mixed with other general wastes for the preservation of environmental sanitation. Such disposal is also desirable for the preservation of privacy or in respect of the sense of sight and smell.

In the abovementioned present condition, however, not a few accidents happens owing to thrown injection syringes or disused sharp medical instruments. Various biochemical wastes including the dead bodies and excretions of experimental animals and disused cultivations produced in the medical laboratories and plants are also posing a problem to environmental sanitation.

Since the remains of animal and vegetable food produced in food processing palants, food selling stores and stations are liable to give off a bad smell, it is desirable to dispose of them selectively and promptly in the vicinity of those places before they are mixed with general wastes.

However, those wastes from the medical institutions, laboratories and plants and food selling stores include watery and incombustible wastes in many cases. So it is necessary to agitate them properly by human power for dehydrated incineration in order to promote complete combustion under low-efficient radiation and conduction in an oil or gas burner. Thus, it requires a great deal of labor. Moreover, it is difficult to achieve complete combustion. And there being many septic wastes which are malodorant and infectious, a sensual problem or danger is also involved when operations are conducted.

Furthermore, medical wastes are frequently inclusive of those wastes containing an explosive inflamable such as alcohol and direct incineration by an oil or gas burner is liable to cause explosive ignition before commencement.

SUMMARY OF THE INVENTION

The present invention is contrived in consideration of those problems posed by the art heretofore in use.

It is therefore an object of the present invention to provide an incinerator which can easily and certainly incinerate even incombustibe wastes containing a lot of moisture, requiring no agitation to expand the heatable area of wastes to be incinerated or to improve the heatable efficiency thereof, thereby posing no problem to safe sanitation, can promptly and properly dispose of those wastes which are septic and malodorant by being installed in the neighborhood of waste-producing places, can prevent even those wastes containing an explosive inflammable such as alcohol from being explosively ignited, can do away with a pyrolytic smell, harmful material or smoke in the discharged waste gas and can prevent harmful material from being discharged through an exhaust means from its secondary combustion chamber by maintaining the pyrolytic temperature of harmful material contained in wastes or produced within the incinerator.

In order to accomplish said object, the present invention is equipped with a primary combustion chamber which accomodates wastes, a secondary combustion chamber, a communicating means which introduces gas to the secondary combustion chamber from the primary combustion chamber, an exhaust means for discharging waste gas from the second combustion chamber and a microwave generation means.

The primary combustion chamber is equipped with a microwave irradiation part which desiccates and/or pyrolyzes accommodated wastes by applying thereto the microwaves generated in the microwave generation means, a first combustion means for waste incineration by flames and a first temperature measuring means for measuring the temperature within the primary combustion chamber.

The secondary combustion chamber is equipped with a second combustion means for incinerating those gases introduced from the primary combustion chamber.

Moreover, the present invention can be provided with an oxygen-containing gas supply means for supplying oxygen-containing gas to the primary combustion chamber.

The present invention can also be equipped with a primary combustion chamber, a communicating means, a secondary combustion chamber, a gas purge measuring means which measures that the gas which contains oxygen in an amount engough to purge inflammable gas existent within an exhaust means through the exhaust means is supplied to the primary combustion chamber by said oxygen-containing gas supply means and a first control means for operating the second combustion means when it is measured by the gas purge measuring means that said amount of oxygen-containing gas is supplied to the primary combustion chamber.

Also, it is desirable that the present invention is constituted so that the oxygen-containing gas supplied by said oxygen-containing gas supply means may be supplied to the primary combustion chamber via the neighborhood of microwave irradiation part.

Furthermore, the present invention can be equipped with a detection means for detecting that the secondary combustion chamber is placed in a position to incinerate the gas introduced from the primary combustion chamber by the operation of said second combustion means and a second control means for commencing the irradiation of those microwaves from the microwave irradiation part when it is detected by the detection means that the secondary combustion chamber is placed in a position to incinerate the gas introduced from the primary combustion chamber by the operation of said second combustion means.

The present invention can also be equipped with a third control means for operating the first combustion means when the temperature measured by a first temperature measuring means according to the irradiation of those microwaves from the microwave irradiation part attains to a given temperature.

It is desirable that the present invention is equipped with a second temperature measuring means for measuring the temperature of secondary combustion chamber and a fourth control means for controlling the combustion characteristics of second combustion means so that the temperature of secondary combustion chamber may be maintained nearly above the set temperature by drawing a comparison between the temperature measured by the second temperature measuring means and the set temperature.

In the invention according to claim 1, when the microwaves from the microwave irradiation part of primary combustion chamber begin to be applied to the wastes after wastes are accommodated in the primary combustion chamber and the secondary combustion chamber is placed in a position to incinerate those gases introduced from the primary combustion chamber, the wastes in the primary combustion chamber generate heat from the inside and moisture or alcohol or other liquid contained therein is efficiently volatilized and the wastes are thereby desiccated and pyrolyzed. Unlike by surface heating, agitation to expand the heatable area of wastes or to impove heatable efficiency is not required. It is effective even to the heating of the remaining liquid in a glass container. Those gases generated by evaporation or pyrolysis are introduced into the seocndary combustion chamber through the communicating means and incinerated therein. Pyrolytic smell-containing gases are thereby deordorized or harmful gases are thereby pyrolyzed.

The first combustion means is operated after it is confirmed that the wastes are easily burnt up when the temperature measured by the first temperature measuring means attains to a given temperature. Then, the wastes are efficiently incinerated in a short peiod of time in the primary combustion chamber. Even the waste containing an explosive inflammable such as alcohol is volatilized by the microwaves. Explosive ignition is prevented by operating the first combustion means after it is incinerated in the secondary combustion chamber. Burning waste gas and smoke of carbon not yet burning are introduced into the secondary combustion chamber through the communicating means and incinerated almost completely. It makes no difference if microwave irradiation is stopped or continued.

The waste gas from which a bad semll, a harmful object or smoke is removed by being incinerated in the secondary combustion chamber is discharged through the exhaust means.

In the invention according to claim 2, when a sufficient amount of oxygen-containing gas is supplied into the primary combustion chamber by the oxygen-containing gas supply means before the second combustion means is operated after wastes are accommodated in the primary combustion chamber, the inflammable gas such as alcohol spreading in the primary combustion chamber, communicating means, secondary combustion means and exhaust means by being concomitant with wastes is discharged through the exhaust means. If the second combustion means is operated thereafter, explosive ignition of inflammable gas is thereby prevented.

In the invention according to claim 3, when it is measured that the gas which contains oxygen in an amount enough to purge the inflammable gas existent in the primary combustion chamber, communicating means, secondary combustion chamber and exhaust means by a gas purge measuring means is supplied into the primary combustion chamber, the second combustion means is operated by the first control means.

In the invention according to claim 4, when the oxygen-containing gas supply means is operated during the operation of first combustion means, the oxygen-containing gas is supplied into the primary combustion chamber via the vicinity of microwave irradiation part, and so the microwave irradiation part is prevented from being damaged by the heat generated by the operation of first combustion means and combustion of wastes.

In the invention according to claim 5, when it is detected by the detection means that the secondary combustion chamber is placed in a position to incinerate those gases introduced from the primary combustion chamber by the operation of second combustion means, irradiation of microwaves from the microwave irradiation part is automatically commenced by the second control means.

In the invention according to claim 6, it is automatically confirmed by a third control means that wastes are easily burnt when the temperature measured by the first temperature measuring means according to the irradiation of microwaves from the microwave irradiation part attains to a given temperature and the first combustion means is thereby operated.

In the invention according to claim 7, the combustion characteristics of the second combustion means is controlled by a fourth control means when a comparison is drawn between the temperature measured by the second temperature measuring means and the set temperature, and the temperature of the secondary combustion chamber is thereby maintained nearly above the set temperature.

BRIEF DESCRIPTION OF THE DRAWINGS

An embodiment of the present invention will now be described by referring to the drawings attached hereto.

DETAILED DESCRIPTION OF THE PREFERRED EMBODIMENT

Figure 1:
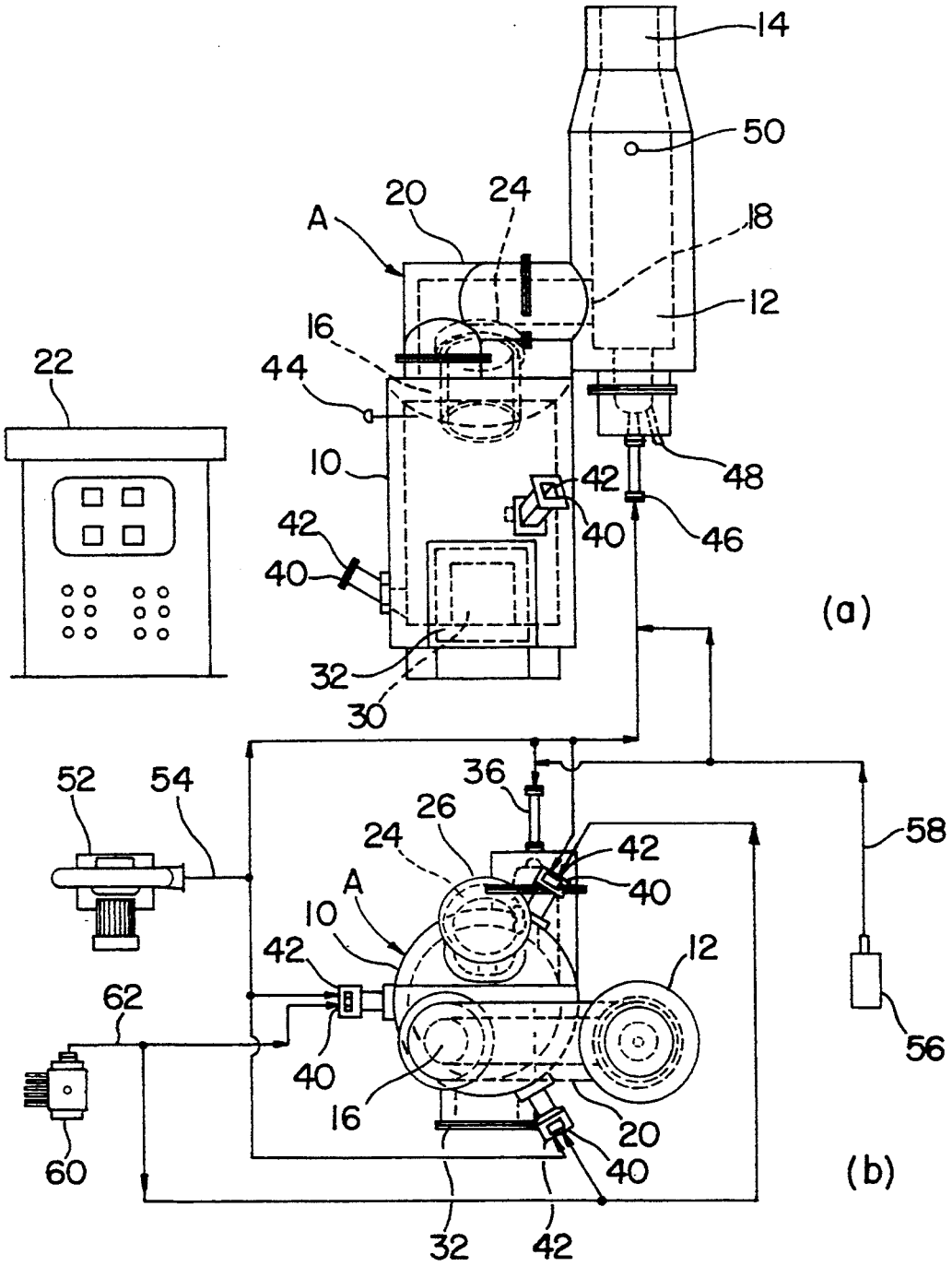
FIG. 1 illustrate an incinerator of the present invention.
Figure 2:
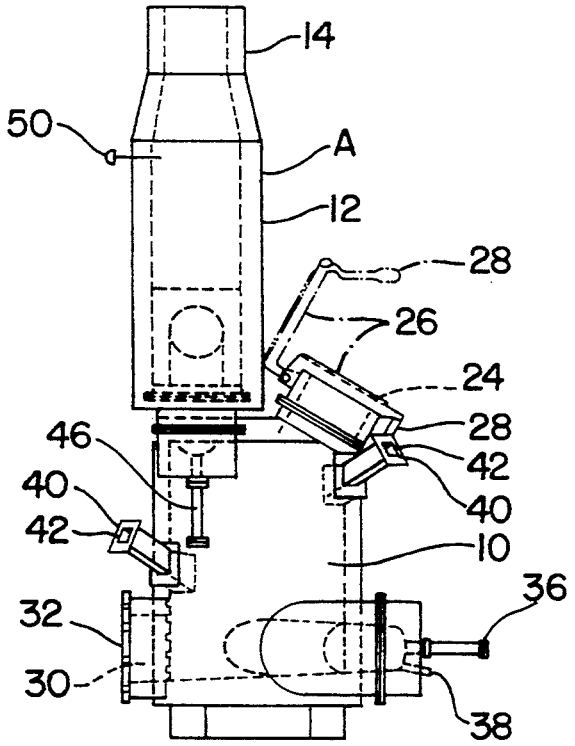
FIG. 2 is a side view of the main body of the present invention.

In FIG. 1, a is a front view of the main body A of the present invention. b is a plane view thereof.

10 is a nearly cylindrically formed primary combustion chamber with its crust being a steel plate and inner wall lined with fireproof material. The primary combustion chamber will do if its crust and inner wall are formed of steel plates and adiabatic material is filled between them, for example. 12 is a nearly cylindrically formed secondary combustion chamber with its crust being a steel plate and inner wall lined with fireproof material. It is installed above the primary combustion chamber. 14 is a nearly cylindrically formed exhaust tube with its crust being a steel plate and inner wall lined with fireproof material. The lower end of the exhaust tube 14 is connected to the upper end of the secondary combustion chamber 12 and the upper end thereof is open upwards. 16 is an exhaust mouth installed at the front upper end of the primary combustion chamber 10 to discharge those gases generated in the primary combustion chamber 10. 18 is an introducing mouth for introducing gases into the secondary combustion chamber 12. It is installed on the lower end side of the secondary combustion chamber 12. 20 is a gas feeding duct (one example of communicating means) with its crust being a steel plate and inner wall lined with fireproof material. This gas feeding duct 20 is installed covering the exhaust mouth 16 and the introducing mouth 18 and introduces gases into the secondary combustion chamber 12 from the primary combustion chamber 10. The main body A of the present invention is comprised of the primary combustion chamber 10, secondary combustion chamber 12, exhaust tube 14 and gas feeding duct 20.

22 is an operation control board equipped with a power distribution device which receives a power source and distributes it to each device and apparatus, a control device which controls each device and apparatus and an operation device which operates each device and apparatus.

As to wiring, it is not illustrated.

24 is an offering mouth for offering wastes into the primary combustion chamber 10. It is installed that the rear upper end of the primary combustion chamber 10. 26 is a freely openable/closable cover for closing the offering mouth 24. It is equipped with a clamp 28. 30 is a remains discharging mouth for discharging the remains of wastes after incineration. It is installed on the front side of the lower end of the primary combustion chamber 10. 32 is a freely openable/closable cover for closing the remains discharging mouth 30. It is equipped with a clamp(not illustrated).

36 is a first gas burner(one example of first combustion means) installed at the lower rear end of the primary combustion chamber 10. 38 is a first flame sensor for sensing the flames of the first gas burner 36. Starting, stopping and combustion characteristics of the first gas burner 36 are electrically controlled by the control device of the operation control board 22. The information sensed by the first flame sensor 38 is transmitted to the control device of said operation control board 22 as an electric signal. Of course, it is possible to adopt other known combustion means as the first combustion means such as an oil burner.

40 is a microwave irradiation part for applying microwaves to the wastes accommodated in the primary combustion chamber 10. The microwave irradiation part 40 is installed in such three places as the upper part, the middle and the lower part of the side wall of the primary combustion chamber 10 as shown in FIG. 1(*a*) to apply microwaves to the whole wastes and each microwave irradiation part 40 is placed at a central angle of 120° as illustrated in FIG. 1(*b*) and a glancing angle is placed at a dip of 15° to 30° in consideration of the characteristics of an electric wave. It goes without saying that the placement and glancing angle of microwave irradiation part 40 can be properly determined according to the charactreristics of the primary combustion chamber 10. It is possible to place it in the ceiling.

In order to prevent the irradiated microwaves from leaking to the outside of the incinerator via the gas feeding duct 20, secondary combustion chamber 12 and exhaust tube 14, it is desirable to form those meshes which are effective for the prevention of leakage according to the wavelength with a conductive material such as highly heat-resisting and corrosion-resisting metal and install them in the leaking route, for example, over the entire section of gas feeding duct 20. As the inside of exhaust tube 14 attains to a high temperature, it is practically impossible to install such meshes. Therefore, the meshes are installed in the form of a chimney arrester in the exhaust tube 14.

42 is an air supply part equipped with a valve which adjusts the amount and pressure of air(for example, oxygen-containing gas) for supply to the primary combustion chamber 10. In this embodiment, the air supply part 42 is installed in the same place as each microwave irradiation part 40, so that the air supplied from the air supply part 42 is supplied into the primary combustion chamber 10 via the neighborhood of microwave irradiation part 40. The operation of the valve installed in the air supply part 42 is controlled by the control device of operation control board 22.

44 is a first temperature sensor installed on the upper side of the primary combustion chamber 10 for measuring the temperature thereof. The temperature information sensed by the first temperature sensor is transmitted to the control device of operation control board 22 as an electric signal.

46 is a second gas burner(one example of second combustion means) installed at the lower end of secondary combustion chamber 12 and 48 is a second flame sensor for sensing the flames of second gas burner 46. Starting, stopping and combustion characteristics are controlled by the control device of operation control board 22.

The information sensed by the second flame sensor 48 is transmitted to the control device of operation control board 22 as an electric signal. Of course, it is possible to adopt other known means, such as a gas burner, as the second combustion means.

50 is a second temperature sensor installed on the upper side of secondary combustion chamber 12 for measuring the temperature thereof. The information sensed by the second temperature sensor 50 is transmitted to the control device of operation control board 22 as an electric signal.

52 is a blower, namely, an air supply source for supplying air to the air supply part 42, first gas bruner 36 and second gas burner 46. The air from the blower 52 is supplied to each air supply part 42, first gas burner 36 and second gas burner 46 through an air supply tube 54.

Starting and stopping of the blower 52 is controlled by the control device of operation control board 22. This blower 52, the air supply tube 54 and the air supply part 42 form one example of oxygen-containing fax supply means.

As an air supply means, the known means such as compressor can be adopted.

56 is an LPG container, namely, a fuel supply source, for supplying LPG to the first gas burner 36 and second gas burner 46. In the case of a gas burner, it can be a town gas terminal. In the case of an oil burner, it can be a service tank for fuel oil, such as heavy oil and kerosene. The LPG from the LPG container 56 is supplied to the first gas burner 36 and second gas burner 46 through a fuel supply tube 58. Opening and closing of LPG container 56 is electrically controlled by the control device of operation control board 22.

60 is a microwave generator(one example of microwave generation means) which generates microwaves of ISM band 2450 MHz or 915 MHz assigned internationally for industrial and medical uses. Starting and stopping of microwave generator 60 is electrically controlled by the control device of operation control board 22. The microwaves generated from the microwave generator 60 is transmitted to the microwave irradiation part 40 through a microwave directing tube 62. For transmission, It is possible to use a means other than the microwave directing tube 62. It is also possible to integrate the microwave generator and the microwave irradiation part 40.

In such an incinerator as described hereinabove, incineration is commenced by inserting wastes into the primary combustion chamber 10 from the offering mouth 24, closing the cover 26, fixing it with the clamp 28 and then by the control device of operation control board 22.

Then, the valve of each air supply part 24 opens by the control device and the blower 52 starts and air is supplied into the primary combustion chamber 10, so that inflammable gas, such as alcohol, spreadable in the inside of primary combustion chamber 10, gas feeding duct 20, secondary combustion chamber 12 and exhaust tube 14 by being concomitant with the wastes is purged through the exhaust tube 14.

When the control device of operation control board 22 measures by a built-in timer means that air enough to nearly completely purge the inflammable gas existent in the inside of primary combustion chamber 10, gas feeding duct 20, secondary combustion chamber 12 and exhaust tube 14 is supplied into the primary combustion chamber 10, LPG is supplied from the LPG container 56 by the control device and the second gas burner 46 starts(first control means). Then, flames are formed in the secondary combustion chamber 12 and the inside of secondary combustion chamber 12 and exhaust tube 12 is heated. As the second gas burner 46 starts after inflammable gas is discharged, explosive ignition of inflammable gas is certainly prevented. In case there exists no inflammable gas, such a purging process is not required.

When it is confirmed by the control device of operation control board 22 according to the information sensed by the second flame sensor 48 and second temperature sensor 50 that combustion is commenced, flames are stabilized and the inside of secondary combustion chamber 12 reached the temperature set so as to incinerate those gases introduced from the primary combustion 10, the microwave generator 60 starts(second control means). The microwaves generated from the microwave generator 60 are applied to the wastes accommodated in the primary combustion chamber 10 from the microwave irradiation part 40 through the wave directing tube 62.

Then, the wastes generate heat from the inside without requiring agitation. Water contained therein, alcohol or other liquid is efficiently volatilized and wastes are desiccated and pyrolized for easy combustion. It is also effective for heating the remains in a glass container. In the case where the output of microwaves is 8kw and wastes are 45 kg, temperature within the primary combustion chamber 10 reaches 120° C. to 150° C. within 100 to 150 minutes after commencement of microwave irradiation. When the output of microwaves is constant, temperature in the primary combustion chamber 10 rises rapidly like a secondary curve with the lapse of irradiation time. The reason is considered to be that temperature rise in the initial stage is retarded by a loss to the lining and by wresting the evaporation heat of liquid such as water and that incidence efficiency in the latter stage is improved by the partial commencement of waste carbonization. Those gases generated by evaporation or pyrolysis are introduced into the secondary combustion chamber 12 through the gas feeding duct 20 and incinerated therin and pyrolitic smell-containing gases are therby deordorized or harmful gases are thereby pyrolyzed.

Information of temperature which rises rapidly by microwave irradiation in the primary combustion chamber 10 is sensed by the first temperature sensor 44 and transmitted to the control device. It is desirable to properly adjust the output of microwave generator 60 by the control means according to a temperature change sensed by the first temperature sensor 44.

If the control device ascertains easy combustion of wastes when the temprature sensed by the first temperature sensor 44 reaches a given temperature (for example, 120° C. to 150° C.), it starts the first burner 36 (a third control means). Then, the wastes are efficiently incinerated by the flames of first gas burner 36, for example, at a high temperature of more than 800° C. or 1000° C. in a short period of time in the primary combustion chamber 10. Even the waste containing such an explosively ignitable material as alcohol evaporates its alcohol by the microwaves. The first gas burner 36 operates after it is incinerated in the secondary combustion chamber and explosive ignition is thereby prevented. When the temperature within the first combustion chamber 10 reaches 120° C. to 150° C., water is volatilized and wastes are easily burnt, and so fuel used in the first gas burner 36 is saved and explosive combustion concomitant with wastes is prevented. The temperature within the primary combustion chamber momentarily reaches 400° C. to 500° C. and rises above 800° C. within 5 to 6 minutes.

Since the air supplied from the air supply part 42 is supplied into the primary combustion chamber 10 via the neighborhood of microwave irradiation part 40, the microwave irradiation part 40 is prevented from being damaged by the heat generated by the flames of first gas burner 36 and combustion of wastes. The air is also used as air for combustion of the wastes accommodated in the primary combustion chamber 10. It makes no difference if irradiation of microwaves from the microwave irradiation part 40 is stopped or continued. If a water-cooling device which can cool the microwave irradiation part 40 is installed at need, the microwave irradiation part 40 can be prevented more efficiently from being damaged.

Burning waste gas and the so-called smoke of carbon not yet burning produced by the first gas burner 36 and combustion of wastes are introduced into the secondary combustion chamber 12 through the gas feeding duct 20 and incinerated nearly completely in the secondary combustion chamber 12. When the temperature within the primary combustion chamber 10 rises above 800° C., it is very easy to maintain the temperature of exhaust gas is discharged from the exaust tube 14 above 700° C., a standard set by law, because burning waste gas is immediately fed into the secondary combustion chamber 12 at the same time that the second gas burner 46 burns. The waste gas from which a bad smell, a harmful object or smoke is removed by incineration is discharged through the exhaust means.

In this embodiment, the combustion characteristics of second gas burner 46 is adjusted by drawing a comparison between the temperature set above the pyrolytic temperature of these harmful objects, for example, HCN, PCDDs and PCDFs, and the temperature measured by the second temperature sensoer 50 and the temperatrue within the secondary combustion chamber 12 is automatically maintained nearly above the set temperature(a fourth control means). Therefore, harmful objects are effectively prevented from being discharged through the exhaust tube 14.

In the case where a harmful or malodorous substance which is not pyrolyzed or whose pyrolytic temperature is notably high as the so-called fumes or steams of metal-containing inorganic substance and inorganic compound is discharged, it is desirable to separate it by installing the known exhaust gas disposal device, such as a scrubber, at the next step of the exhaust means of the present invention.

As descried above, the temperature within the secondary combustion chamber 12 which is set in the control device of operation control board 22 is usually set so that the temperature of exhaust gas discharged from the exhaust tube 14 may reach 700° C. to 1200° C. In the case where it is expected that a chlorine compound or a fluorine compound is mixed with wastes, it is desirable to set the temperature so that the temperature of exhaust gas may reach 1350° C. to 1400° C.

Such set temperature is achieved and maintained by the controlled combustion continuation of second gas burner 46. The set temperature can be reached within 15 minutes or so after the second gas burner 46 is started.

Thereafter, if the control device detects that combustion of those wastes in the primary combustion chamber 10 is brought to a finish according to the temperature information sensed by the first temperature sensor 44, supply of LPG from the LPG container 56 is stopped by the control device and, at the same time, the operation of first gas burner 36, second gas burner 46 and microwave generator 60 is stopped. As the next step, if it is detected by the first temperature sensor 44 that the temperature within the primary combustion chamber 10 went down below the temperature, for example, 100° C. at which remains can be discharged, the blower 52 is stopped by the control device and, at the same time, the valve of each air supply part 42 is closed. Then, the remains can be diacharged by using a discharging tool when the cover 32 of remains discharging mouth 30 is opened.

Results of tested incineration

Results of incinerating 35 kg of rotten fresh fish(moisture about 73%) and 10 kg of rotten fresh pork(moisture about 70%) by the above-embodied incinerator wherein the output of first gas burner 36 amounts to 50000 Kcal/hr, the output of second gas burner 46 to 70000 Kcal/hr and the microwave generator to 2,450 MHz.10 kw are shown in the Table 1 and Table 2.

The above embodiment describes about automatic control, but a manual control makes no difference.

In the incinerator according to claim 1, when the first combustion means is operated after wastes are accommodated in the primary combustion chamber and the secondary combustion chamber is placed in a position to incinerate introduced gases by the operation of second combustion means and after irradiation of microwaves from the microwave irradiation part is commenced and it is confirmed that the temperature measured by the first temperature measuring means reached a given temperature, wastes are desiccated, pyrolyzed and easily burnt by the microwaves and then incinerated efficinetly in a short period of time in the primary combustion chamber. Therefore, even those incombustible wastes containing a great deal of mositure can be incinerated easily and certainly. And even those wastes containing an explosively ignitable substance like alcohol are prevented from being explosively ignited by the operation of first combustion means after alcohol is volatilized by the microwaves and incinerated in the secondary combustion chamber.

Since those gases produced by evaporation or pyrolysis in the process where wastes are easily burnt, and burning waste gas produced by the icineration of wastes and the so-called smoke of carbon not yet burning are completely incinerated in the secondary combustion chamber and waste gas from which a bad smell or a harmful object is almost removed by incineration are discharged through the exhaust means, environmental pollution is also prevented.

Easy combustion by the microwaves is conducted by the generation of heat from the inside of wastes. Since it is effective even to the heating of the remaining liquid in a container, for example, the remaining liquid in a glass container used for uroscopy and scatoscopy and wastes after easy combustion can be efficiently incinerated by the first combustion means, agitation to expand the heatable area of wastes or to improve the heatable efficiency thereof is not required. In this respect, a safe environmental problem is also solved. Accordingly, wastes can be incinerated easily and safely by installing the present invention in the vicinity of each place where wastes are produced. Moreover, those wastes which must be stocked and disposed of in complete isolation from general environment for the preservation of environmental sanitation, such as medical wastes or biochemical wastes produced when researches in medicines are conducted or medicines are manufactured and those wastes which are stronly septic and malodorant can be properly and promptly disposed of as soon as they are produced.

In the incinerator according to claim 2, if a sufficient amount of oxygen-containing gas is supplied into the primary combustion chamber before the operation of second combustion means after wastes are accommodated, inflammable gas spreadable in the inside of incinerator by being concomitant with wastes is purged through the exhaust means and its explosive ignition caused by the operation of second combustion means is thereby prevented.

In the incinerator according to claim 3, when it is measure by the gas purge measuring means that the gas which contains oxygen in an amount enough to purge inflammable gas existent in the primary combustion chamber, communicating means, secondary combustion chamber and exhaust means through the exhaust means is supplied into the primary combustion chamber, the second combustion means is operated by the first control means and explosive ignition of inflammable gas is automatically prevented.

In the incinerator according to claim 4, when the oxygen-containing gas supply means is operated during the operation of first combustion means, the oxygen-containing gas is supplied into the primary combustion chamber via the neighborhood of microwave irradiation part, and so the microwave irradiation part is prevented from being damaged by the heat generated by the operation of first combustion means and combustion of wastes and life can be thereby added to the durability of incinerator.

In the incinerator according to claim 5, when it is detected by the detection means that the secondary combustion chamber is placed in a position to incinerate those gases introduced from the primary combustion chamber by the operation of second combustion means, irradiation of microwaves from the microwave irradiation part is automatically commenced by the second control means.

Therefore, those gases generated by evaporation or pyrolysis according to microwave irradiation are certainly incinerated in the secondary combustion chamber.

In the incinerator according to claim 6, it is automatically confirmed by the third control means that wastes are easily burnt when the temperature measured by the first temperature measuring means according to the irradiation of microwaves from the microwave irradiation part attains to a given temperature, and the first combustion means is thereby operated. Therefore, wastes are efficiently incinerated in a short period of time in the primary combustion chamber.

In the incinerator according to claim 7, the combustion characteristics of second combustion means is controlled by the fourth control means when a comparison is drawn between the temperature measured by the second temperature measuring means and the set temperature, and the temperature of secondary combustion chamber is thereby maintained nearly above the set temperature. Therefore, a harmful substance is prevented from being discharged through the exhaust means from the secondary combustion chamber by maintaining the pyrolytic temperature of harmful substance contained in wastes or produced in the incinerator.

TABLE 1

| (The process where desiccating and easy incineration is possible: the output of microwave 8kw, the output of secondary gas burner 70,000 kcal operation) | | | | | | | | |
|---|---|---|---|---|---|---|---|---|
| The amount of discharging moisture burning waste gas $Nm^3/hr$ | discharging gas temperatrue °C. | CO % | $CO_2$ % | $SO_2$ ppm | $H_2S$ ppm | explosive concentration $g/Nm^3$ | temperature in a primary combustion chamber °C. | the time required min |
| 69.1 | 1,015 | 0 | 9.5 | 0 | not more than 1 | 0 | 126 | 127 |

TABLE 2

| (Complete incineration process: the output of microwave 8kw, the output of secondary gas burner (46) 50,000 kcal operation) | | | | | | | | | |
|---|---|---|---|---|---|---|---|---|---|
| The amount of discharging moisture burning waste gas $Nm^3/hr$ | dishcarging gas temperature °C. | CO % | $CO_2$ % | $SO_2$ ppm | $H_2S$ ppm | explosive concentration $g/Nm^3$ | temperatrue in a primary combustion chamber °C. | the time required min | post incineration residue, quantity of heat lost % |
| 382.3 | 1,169 | 0 | 12.3 | 24 | not more than 1 | 0.02 | 864 | 47 | 0.16 |

What is claimed is:

1. An incinerator, comprising:

a primary combustion chamber for accommodating wastes, a secondary combustion chamber, a communicating means for introducing gases to the secondary combustion chamber from the primary combustion chamber, an exhaust means for discharging waste gas from the secondary combustion chamber and a microwave generation means, wherein the primary combustion chamber includes:

a microwave irradiation part for applying microwaves generated in the microwave generation means to the accommodated wastes and desiccating and/or pyrolyzing them, a first combustion means for incinerating the wastes and a first temperature measuring means for measuring the temperature within the primary combustion chamber; and wherein the secondary combustion chamber includes a second combustion means for incinerating those gases introduced from the primary combination chamber.

2. The incinerator according to claim 1, further comprising:

an oxygen-containing gas supply means for supplying oxygen-containing gas into the primary combustion chamber.

3. The incinerator according to claim 2, further comprising:

a gas purge measuring means for measuring that the oxygen-containing gas is supplied through the exhaust means into the primary combustion chamber by said oxygen-containing gas supply means; and a first control means for operating the second combustion means when said amount of oxygen-containing gas is supplied into the primary combustion chamber by the gas purge measuring means;

wherein the oxygen-containing gas contains oxygen in an amount enough to purge inflammable gas existent in the inside of the primary combustion chamber, secondary combustion chamber, and exhaust means.

4. The incinerator according to claim 2, wherein the oxygen-containing gas supplied by the oxygen-containing gas supply means may be supplied into the primary combustion chamber by said oxygen-containing gas supply means.

5. The incinerator according to claim 1, further comprising a detection means for detecting that the secondary combustion chamber is placed in a position to incinerate those gases introduced from the primary combustion chamber by the operation of said second combustion means and a second control means for commencing the irradiation of microwaves from the microwave irradiation part when it is detected by the detection means that the secondary combustion chamber is placed in a position to incinerate those gases introduced from the primary combustion chamber by the operation of said second combustion means.

6. The incinerator according to claim 1, further comprising a third control means for operating the first combustion means when the temperature measured by the first temperature measuring means reaches a given temperature according to the irradiation of microwaves from the microwave irradiation part.

7. The incinerator according to claim 1, further comprising a second temperature measuring means for measuring the temperature within the secondary combustion chamber and a fourth control means for controlling the combustion characteristics of said second combustion means so that the temperature within the secondary combustion chamber may be maintained nearly above a predetermined temperature by drawing a comparison between the temperature measured by the second temperature measuring means and the predetermined temperature.

8. The incinerator according to claim 3, wherein the oxygen-containing gas supplied by the oxygen-containing gas supply means may be supplied into the primary combustion chamber by said oxygen-containing gas supply means.

9. The incinerator according to claim 2, further comprising a detection means for detecting that the secondary combustion chamber is placed in a position to incinerate those gases introduced from the primary combustion chamber by the operation of said second combustion means and a second control means for commencing the irradiation of microwaves from the microwave irradiation part when it is detected by the detection means that the secondary combustion chamber is placed in a position to incinerate those gases introduced from the primary combustion chamber by the operation of said second combustion means.

10. The incinerator according to claim 3, further comprising a detection means for detecting that the secondary combustion chamber is placed in a position to incinerate those gases introduced from the primary combustion chamber by the operation of said second combustion means and a second control means for commencing the irradiation of microwaves from the microwave irradiation part when it is detected by the detection means that the secondary combustion chamber is placed in a position to incinerate those gases introduced from the primary combustion chamber by the operation of said second combustion means.

11. The incinerator according to claim 4, further comprising a detection means for detecting that the secondary combustion chamber is placed in a position to incinerate those gases introduced from the primary combustion chamber by the operation of said second combustion means and a second control means for commencing the irradiation of microwaves from the microwave irradiation part when it is detected by the detection means that the secondary combustion chamber is placed in a position to incinerate those gases introduced from the primary combustion chamber by the operation of said second combustion means.

12. The incinerator according to claim 2, further comprising a third control means for operating the first combustion means when the temperature measured by the first temperature measuring means reaches a given temperature according to the irradiation of microwaves from the microwave irradiation part.

13. The incinerator according to claim 3, further comprising a third control means for operating the first combustion means when the temperature measured by the first temperature measuring means reaches a given temperature according to the irradiation of microwaves from the microwave irradiation part.

14. The incinerator according to claim 4, further comprising a third control means for operating the first combustion means when the temperature measured by the first temperature measuring means reaches a given temperature according to the irradiation of microwaves from the microwave irradiation part.

15. The incinerator according to claim 5, further comprising a third control means for operating the first combustion means when the temperature measured by the first temperature measuring means reaches a given temperature according to the irradiation of microwaves from the microwave irradiation part.

16. The incinerator according to claim 2, further comprising a second temperature measuring means for measuring the temperature within the secondary combustion chamber and a fourth control means for controlling the combustion characteristics of said second combustion means so that the temperature within the secondary combustion chamber may be maintained nearly above a predetermined temperature by drawing a comparison between the temperature measured by the second temperature measuring means and the predetermined temperature.

17. The incinerator according to claim 3, further comprising a second temperature measuring means for measuring the temperature within the secondary combustion chamber and a fourth control means for controlling the combustion characteristics of said second combustion means so that the temperature within the secondary combustion chamber may be maintained nearly above a predetermined temperature by drawing a comparison between the temperature measured by the second temperature measuring means and the predetermined temperature.

18. The incinerator according to claim 4, further comprising a second temperature measuring means for measuring the temperature within the secondary combustion chamber and a fourth control means for controlling the combustion characteristics of said second combustion means so that the temperature within the secondary combustion chamber may be maintained nearly above a predetermined temperature by drawing a comparison between the temperature measured by the second temperature measuring means and the predetermined temperature.

19. The incinerator according to claim 5, further comprising a second temperature measuring means for measuring the temperature within the secondary combustion chamber and a fourth control means for controlling the combustion characteristics of said second combustion means so that the temperature within the secondary combustion chamber may be maintained nearly above a predetermined temperature by drawing a comparison between the temperature measured by the second temperature measuring means and the predetermined temperature.

20. The incinerator according to claim 6, further comprising a second temperature measuring means for measuring the temperature within the secondary combustion chamber and a fourth control means for controlling the combustion characteristics of said second combustion means so that the temperature within the secondary combustion chamber may be maintained nearly above a predetermined temperature by drawing a comparison between the temperature measured by the second temperature measuring means and the predetermined temperature.

* * * * *